US007261948B2

(12) United States Patent
Edkins

(10) Patent No.: US 7,261,948 B2
(45) Date of Patent: Aug. 28, 2007

(54) THREE-DIMENSIONAL ORNAMENT AND METHOD OF MAKING SAME

(76) Inventor: Mary Edkins, 1512 Forest Lake Blvd., Naples, FL (US) 34105

( * ) Notice: Subject to any disclaimer, the term of this patent is extended or adjusted under 35 U.S.C. 154(b) by 204 days.

(21) Appl. No.: 11/212,995

(22) Filed: Aug. 26, 2005

(65) Prior Publication Data

US 2007/0048463 A1 Mar. 1, 2007

(51) Int. Cl.
*D04D 7/04* (2006.01)

(52) U.S. Cl. ..... 428/542.6; 428/7; 493/344; 493/394; 493/466; 493/955

(58) Field of Classification Search ..... 428/7, 428/8, 9, 11, 12, 28, 542.2, 542.6, 4, 5; 493/344, 493/352, 356, 394, 466, 955, 959, 480; 446/487; 40/124.09; D11/142
See application file for complete search history.

(56) References Cited

U.S. PATENT DOCUMENTS 3,861,279 A 1/1975 Maling
5,484,378 A 1/1996 Braithwaite
5,609,928 A 3/1997 Yedlin et al.
6,783,815 B2 8/2004 Flohe
2002/0168485 A1 11/2002 Yedlin et al.
2004/0251678 A1 12/2004 Dacey
2004/0256282 A1 12/2004 Glenn
2005/0097799 A1 5/2005 Murthy
2005/0106995 A1 5/2005 Kim

*Primary Examiner*—John J. Zimmerman
*Assistant Examiner*—Aaron Austin
(74) *Attorney, Agent, or Firm*—The Livingston Firm; Edward M. Livingston; Angela M. Miller

(57) ABSTRACT

A three-dimensional ornament (1) comprising a plurality of folded elements (8), (9), (10), (11), (22) and (23) created from a plurality of nesting cuts (6), (7), (20) and (21) in a planar surface (1). The folded elements (8), (9), (10), (11), (22) and (23) are fastened in opposing planes (15), (16) and (28) so as to give a unique and distinctive appearance. A multitude of three-dimensional ornaments (1) may be fastened together to form a snowflake (19) which may be suspended from a ceiling, tree or the like. The planar surface (1) may have a decorative surface and be of various colors, sizes and textures.

20 Claims, 4 Drawing Sheets

THREE-DIMENSIONAL ORNAMENT AND METHOD OF MAKING SAME

BACKGROUND OF THE INVENTION

This invention relates to three-dimensional ornaments, more particularly, a three-dimensional ornament that is attractive and easy to create.

Three-dimensional ornaments made of a flexible, planar surface, such as construction paper, have been used for decorative purposes for many years. Children in school and summer camps would create three-dimensional ornaments, such as Christmas ornaments, for their parents. Retail stores decorate their showrooms with three-dimensional ornaments to give a warmer, friendlier appearance. Even restaurants and hotels use such items to make rooms look more festive.

Although the use of flexible, planar surfaces to construct three-dimensional ornaments for decorating is disclosed in the prior art, the present invention is a new three-dimensional ornament having a distinctive shape which is easy to assemble.

The relevant prior art includes the following references:

| U.S. Pat. No. (U.S. unless stated otherwise) | Inventor | Issue/Publication Date |
|---|---|---|
| 2005/0097799 | Murthy | May 12, 2005 |
| 5,609,928 | Yedlin et al. | Mar. 11, 1997 |
| 5,484,378 | Braithwaite | Jan. 16, 1996 |
| 2004/0251678 | Dacey | Dec. 16, 2004 |
| 2002/0168485 | Yedlin et al. | Nov. 14, 2002 |
| 2004/0256282 | Glenn | Dec. 23, 2004 |
| 2005/0106995 | Kim | May 19, 2005 |
| 3,861,279 | Maling | Jan. 21, 1975 |
| 6,783,815 | Flohe | Aug. 31, 2004 |

SUMMARY OF THE INVENTION

The primary object of the present invention is to provide a three-dimensional ornament that is attractive.

A further object of the present invention is to provide a three-dimensional ornament that is easy to assemble.

An even further object of the present invention is to provide a three-dimensional ornament that is lightweight.

Another object of the present invention is to provide a three-dimensional ornament that may be suspended.

An additional object of the present invention is to provide a three-dimensional ornament that resembles a complex snowflake.

The present invention fulfills the above and other objects by providing a three-dimensional ornament comprising at least one flexible, planar surface having a predetermined area and perimeter having a centrally located spine having a left edge and a right edge. The spine divides the surface into a left side and a right side. A first cut extends from the spine left edge into the left side and returns to the spine left edge to create a first and second folded element which are attached to the spine. A second cut extends from the spine right edge into the right side and returns to the spine right edge to create a third and fourth folded element which are attached to the spine. The first and third folded elements mirror each other in size and shape, as does the second and fourth folded elements. To make the ornament, a person simply folds the first and third folded elements away from the spine so as to fall into a second plane and fastens the first and third folded elements together. Then, a person folds the second and fourth folded elements in an opposite direction from the first and third folded elements so as to fall into a third plane and fastens the second and fourth folded elements together.

An alternate embodiment of the present invention fulfills the above and other objects by providing a three-dimensional ornament further comprising an additional two folded elements located on either side of the spine. In this manner, a series of nesting folded elements are created. For example, the first folded element nests within a second folded element and the second folded element nests within the sixth folded element. To assemble this embodiment, a person follows the steps listed above, and then folds the fifth and sixth folded elements into the second plane and fastens the fifth and sixth folded elements together.

Additionally, a person may fasten a plurality of the three-dimensional ornaments together to create a larger ornament having a unique snowflake-like appearance.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
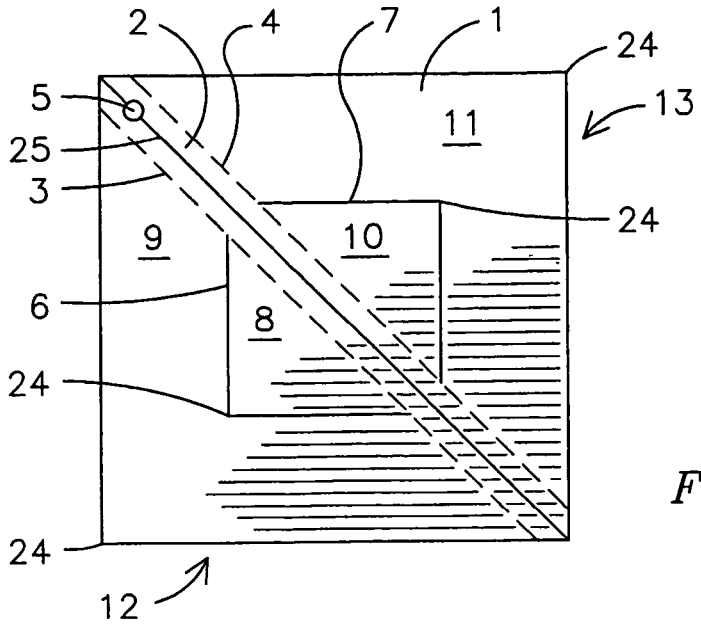
FIG. 1 is a front view of a first embodiment of a three-dimensional ornament of the present invention unassembled.

For purposes of describing the preferred embodiment, the terminology used in reference to the numbered components in the drawings is as follows:

| | |
|---|---|
| 1. | planar surface |
| 2. | spine |
| 3. | spine left edge |
| 4. | spine right edge |
| 5. | hole |

-continued

| | |
|---|---|
| 6. | first cut |
| 7. | second cut |
| 8. | first folded element |
| 9. | second folded element |
| 10. | third folded element |
| 11. | fourth folded element |
| 12. | left side |
| 13. | right side |
| 14. | first plane |
| 15. | second plane |
| 16. | third plane |
| 17. | three-dimensional ornament, generally |
| 18. | lights |
| 19. | snowflake |
| 20. | third cut |
| 21. | fourth cut |
| 22. | fifth folded element |
| 23. | sixth folded element |
| 24. | apex |
| 25. | spine center |
| 26. | apex first plane |
| 27. | apex second plane |
| 28. | fourth plane |

With reference to FIG. 1, a front view of a first embodiment of a three-dimensional ornament of the present invention unassembled is shown. The ornament is assembled by using a substantially planar surface 1 that is foldable, yet sturdy, such as construction paper, posterboard and the like. The planar surface 1 may be of various colors of either a matte or shine finish having differing visual effects, such as glitter, holograms, iridescence, and the like. In addition, the planar surface 1 may be of varying textures. Preferably, the planar surface has an area and perimeter of a square, although other shapes, such as circles, triangles, trapezoids, and so forth may be used. The planar surface 1 includes a centrally located spine 2 having a left edge 3, a right edge 4 and a center 25. The spine 2 divides the planar surface 1 into a left side 12 and a right side 13. A first cut 6 is located in the left side 12 and divides the left side 12 into a first folded element 8 and a second folded element 9. The first cut 6 begins and ends on the spine left edge 3 so as to keep the folded elements 8 and 9 attached to the spine 2. The shape of the first cut 6 should generally follow the shape of the perimeter. A second cut 7 is located on the right side 13 and mirrors the shape and placement of the first cut 6 so as to create a third folded element 10 and a fourth folded element 11 on the right side which are identical to the first and second folded elements 8 and 9. Each of the folded elements 8, 9, 10 and 11 have apexes 24.

Figure 2:
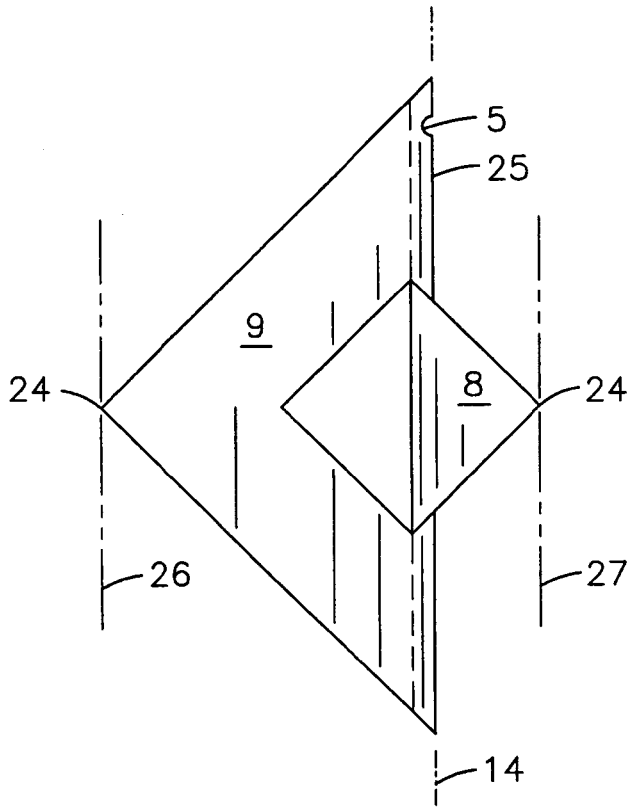
FIG. 2 is a side view of the first embodiment illustrating the directions in which to fold folded elements of the first embodiment of the present invention.

FIG. 2 shows the directions in which to fold folded elements of the first embodiment of the present invention. First, a person fold the planar surface 1 along the spine center 25 so the spine center 25 is located in a first plane 14. Then, a person folds the first folded element 8 and the third folded element 10 away from the spine center 25 so the apexes 24 of the first and third folded elements 8 and 10 are in an apex first plane 26. Then, a person folds the second folded element 9 and the fourth folded element 11 in an opposite direction away from the spine center 25 so the apexes 24 of the second and fourth folded elements 9 and 11 are in an apex second plane 27. The planes 14, 26 and 27 are parallel to one another and placed so as the first plane 14 is located in between the first and second apex planes 16 and 27.

Figure 3:
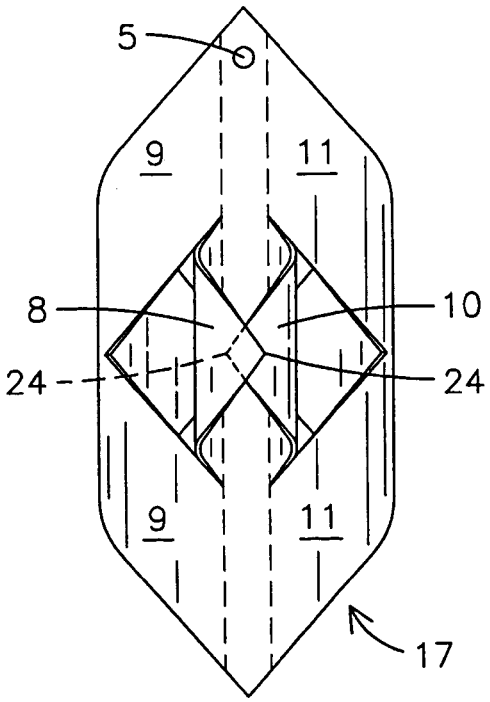
FIG. 3 is a front view of a first embodiment of the present invention when assembled.
Figure 4:
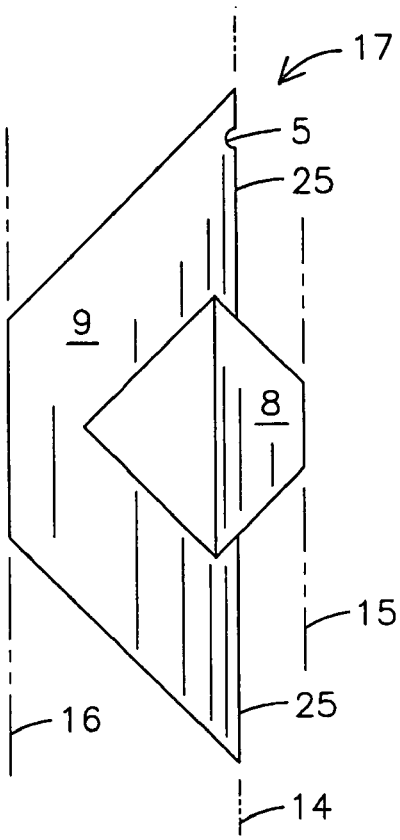
FIG. 4 is a left side view of a first embodiment of the present invention when assembled.

In FIGS. 3 and 4, varying views of a first embodiment of the present invention when assembled are shown. A portion of the apex 24 of the first folded element 8 overlaps a portion of the apex 24 of the third folded element 10 when folded and then the first and third folded elements 8 and 10 are fastened together in a second plane 15 using a fastening means, such as glue, staples, tape, hot glue and other similar means. In a similar manner, a portion of the apex 24 of the second folded element 9 overlaps a portion of the apex 24 of the fourth folded element 11 when folded and then the folded elements 9 and 11 are fastened together in a third plane 16. A user may then hang the three-dimensional ornament 17 by inserting a wire, string, hook or other means in the hole 5.

Figure 5:
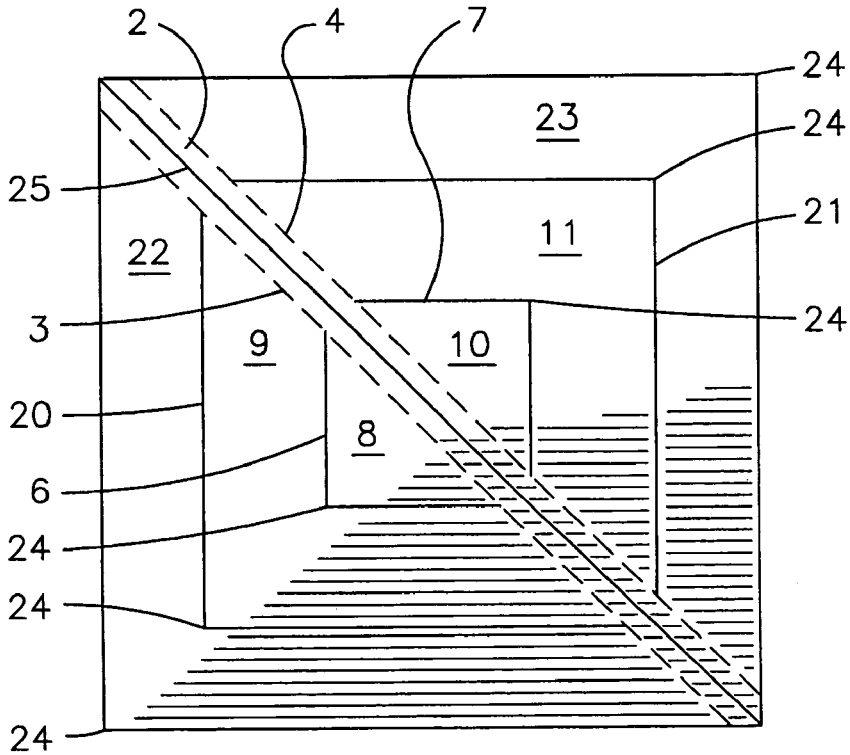
FIG. 5 is a front view of a second embodiment of a three-dimensional ornament of the present invention unassembled.

Next, FIG. 5 shows a front view of a second embodiment of a three-dimensional ornament of the present invention unassembled. The second embodiment of the three-dimensional ornament is similar to the first embodiment except the second embodiment includes a third cut 20 and a fourth cut 21 which create a fifth folded element 22 and a sixth folded element 23. The third cut 20 is sized and shaped so as to allow the second folded element 9 nest within the fifth folded element 22 while the fourth cut 21 is sized and shaped so as to allow the third folded element 11 to nest within the sixth folded element 23.

Figure 6:
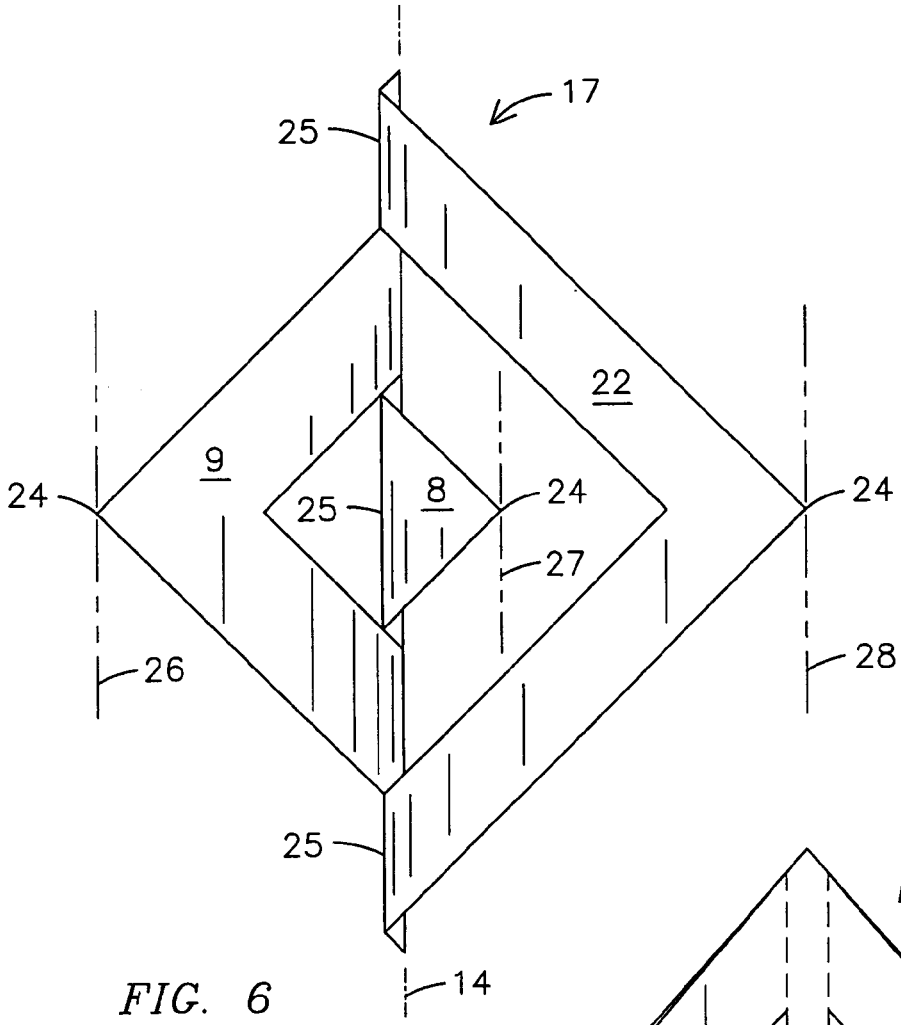
FIG. 6 a side view of the second embodiment illustrating the directions in which to fold folded elements of the second embodiment of the present invention.

In reference to FIG. 6, a side view of various directions in which to fold folded elements of the second embodiment of the present invention is shown. Similar to the first embodiment, the apexes 24 of the first and third folded elements 8 and 10 are folded into an apex first plane 26 and the apexes 24 of the second and fourth folded elements 9 and 11 are folded into an apex second plane 27. However, the apexes 24 of the fifth and sixth folded elements 22 and 23 are folded into a third apex plane 28 to create the ornament.

Figure 7:
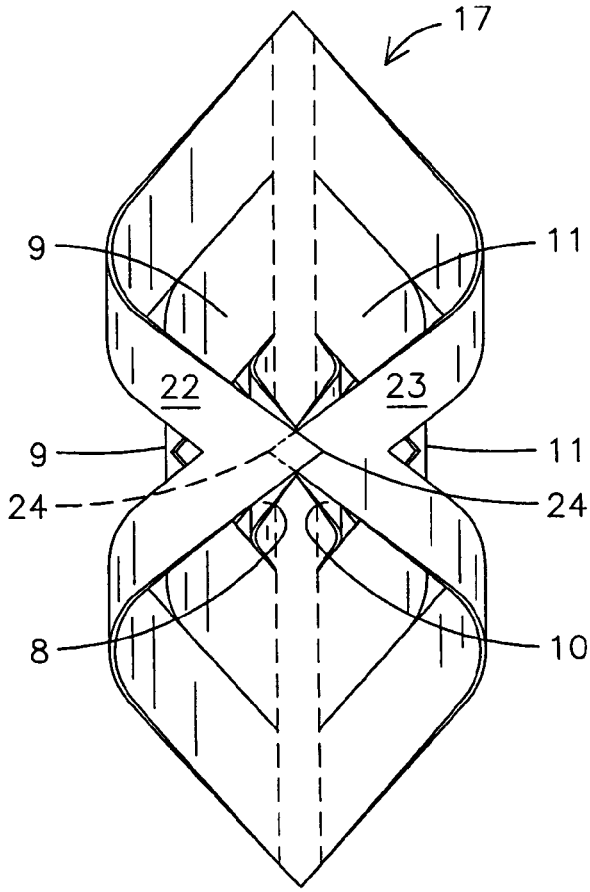
FIG. 7 is a front view of a second embodiment of the present invention when assembled.
Figure 8:
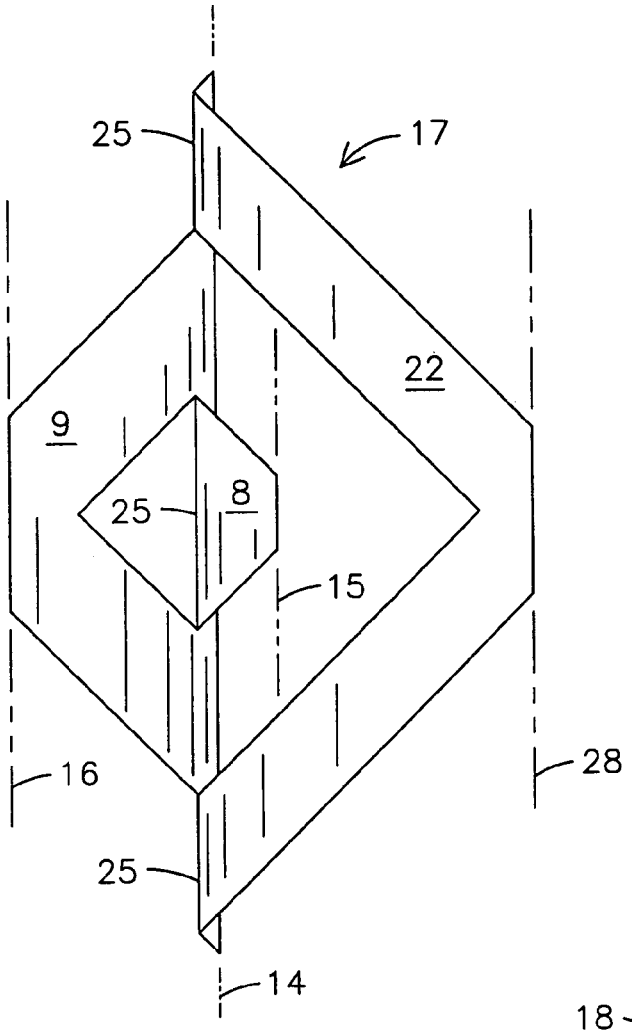
FIG. 8 is a left side view of a second embodiment of the present invention when assembled.

FIGS. 7 and 8 show varying views of a second embodiment of the present invention when assembled. Similar to the first embodiment, a portion of the apex 24 of the first folded element 8 overlaps a portion of the apex 24 of the third folded element 10 when folded and fastened together in the second plane 15 and a portion of the apex 24 of the second folded element 9 overlaps a portion of the apex 24 of the fourth folded element 11 when folded and then the folded elements 9 and 11 are fastened together in the third plane 16. Additionally, however, a portion of the apex 24 of the fifth folded element 22 overlaps a portion of the apex 24 of the sixth folded element 23 and the folded elements 22 and 23 are fastened together in a fourth plane 28.

Figure 9:
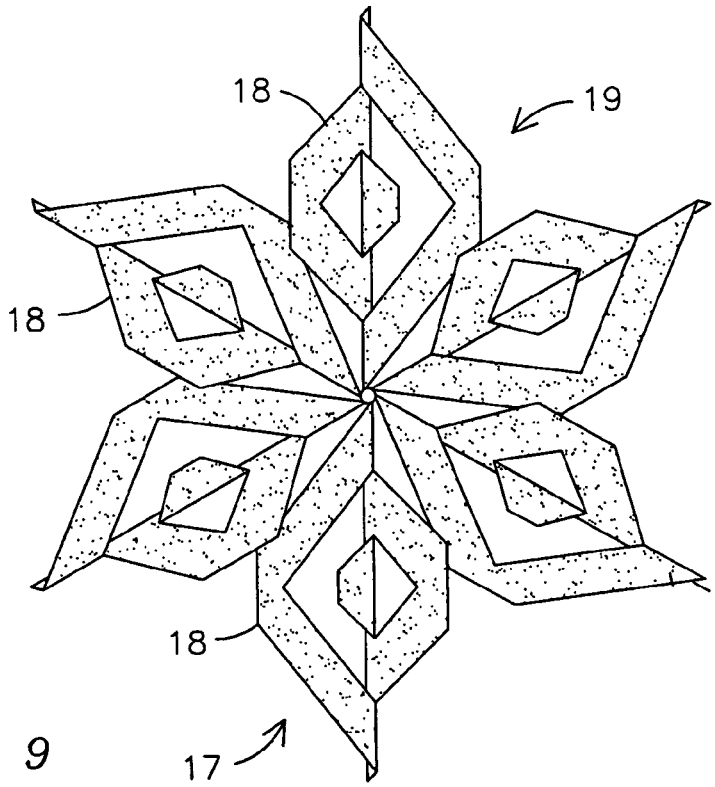
FIG. 9 is a side view of a third embodiment of the present invention when multiple second embodiments are fastened together.

Finally, FIG. 9 shows a side view of a third embodiment of the present invention when multiple second embodiments are fastened together. When a plurality of the three-dimensional ornaments 17 are fastened to one another, a snowflake 19 is created. The snowflake 19 may be hung from a ceiling, tree branch, pole or any other object in a similar manner as described above. In addition, lights 18 may be attached individual three-dimensional ornaments 17 or to the entire snowflake 19 to give a more festive appearance.

The use of the present invention will allow a person to quickly assemble an attractive three-dimensional decorative ornament.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

Having thus described my invention, I claim:

1. A three-dimensional ornament comprising:

at least one flexible, planar surface having a predetermined area and perimeter;

said at least one flexible, planar surface having a centrally located spine;

said spine having a left edge and a right edge and a center;

said spine center located in a first plane;

said spine dividing said at least one flexible, planar surface into a left and a right side;

said spine left edge adjacent to said left side;

said spine right edge adjacent to said right side;

a first cut extending from said spine left edge into said left side and returning to said spine left edge;

a first folded element and a second folded element formed from said first cut within said left side;

the first folded element attached to said spine left edge;

an apex located on said first folded element;

the second folded element located attached to said spine left edge;

an apex located on said second folded element;

said first folded element nests within said second folded element;

a second cut extending from said spine right edge into said right side and returning to said spine right edge;

a third folded element and a fourth folded element formed from said second cut within said right side;

the third folded element attached to said spine right edge;

an apex located on said third folded element;

the fourth folded element located attached to said spine right edge;

an apex located on said fourth folded element;

said third folded element nests within said fourth folded element;

said first folded element apex is fastened to said third folded element apex in a second plane;

said second plane is parallel to said first plane;

said second folded element apex is fastened to said fourth folded element apex in a third plane;

said third plane is parallel to said first plane;

said first plane is located between said second plane and said third plane;

a means for fastening said first and third folded elements in the second plane; and a means for fastening said second and fourth folded elements in the third plane.

2. The three-dimensional ornament of claim 1 further comprising:

a third cut extending from said spine left edge into said left side and returning to said spine left edge to form a fifth folded element within said left side;

the fifth folded element attached to said spine left edge wherein said second folded element nests within said fifth folded element;

an apex located on said fifth folded element;

a fourth cut extending from said spine right edge into said right side and returning to said spine right edge to form a sixth folded element within said right side;

the sixth folded element attached to said spine right edge wherein said fourth folded element nests within said sixth folded element;

an apex located on said sixth folded element;

said fifth folded element apex is fastened to said sixth folded element apex in a fourth plane;

said fourth plane is parallel to said first, second and third planes;

said fourth plane is adjacent to said second plane; and a means for fastening said fifth and sixth folded elements in the fourth plane.

3. The three-dimensional ornament of claim 1 wherein:

said predetermined area and perimeter form a square.

4. The three-dimensional ornament of claim 2 wherein:

said predetermined area and perimeter form a square.

5. The three-dimensional ornament of claim 1 further comprising:

a means for hanging said three-dimensional ornament.

6. The three-dimensional ornament of claim 2 further comprising:

a means for hanging said three-dimensional ornament.

7. The three-dimensional ornament of claim 5 wherein:

said means for hanging is a hole located adjacent to said perimeter.

8. The three-dimensional ornament of claim 6 wherein:

said means for hanging is a hole located adjacent to said perimeter.

9. The three-dimensional ornament of claim 1 wherein:

said means for fastening is glue.

10. The three-dimensional ornament of claim 2 wherein:

said means for fastening is glue.

11. The three-dimensional ornament of claim 1 further comprising:

at least one light secured to said ornament.

12. The three-dimensional ornament of claim 2 further comprising:

at least one light secured to said ornament.

13. The three-dimensional ornament of claim 1 wherein:

glitter may be adhered to said ornament.

14. The three-dimensional ornament of claim 2 wherein:

glitter may be adhered to said ornament.

15. The three-dimensional ornament of claim 1 wherein:

a plurality of three-dimensional ornaments are secured to one another.

16. The three-dimensional ornament of claim 2 wherein:

a plurality of three-dimensional ornaments are secured to one another.

17. A three-dimensional ornament comprising:

at least one flexible, planar surface having a predetermined area and perimeter;

said at least one flexible, planar surface having a centrally located spine;

said spine having a left edge and a right edge and a center;

said spine center located in a first plane;

said spine dividing said at least one flexible, planar surface into a left and a right side;

said spine left edge adjacent to said left side;

said spine right edge adjacent to said right side;

a first cut extending from said spine left edge into said left side and returning to said spine left edge;

a first folded element and a second folded element formed from said first cut within said left side;

the first folded element attached to said spine left edge;

an apex located on said first folded element;

the second folded element located attached to said spine left edge;

an apex located on said second folded element;

said first folded element nests within said second folded element;

a second cut extending from said spine right edge into said right side and returning to said spine right edge;

a third folded element and a fourth folded element formed from said second cut within said right side;

the third folded element attached to said spine right edge;
an apex located on said third folded element;
the fourth folded element located attached to said spine right edge;
an apex located on said fourth folded element;
said third folded element nests within said fourth folded element;
a third cut extending from said spine left edge into said left side and returning to said spine left edge;
said third cut forming a fifth folded element within said left side;
a fifth folded element attached to said spine left edge wherein said second folded element nests within said fifth folded element;
an apex located on said fifth folded element;
a fourth cut extending from said spine right edge into said right side and returning to said spine right edge;
said fourth cut forming a sixth folded element within said right side;
a sixth folded element attached to said spine right edge wherein said fourth folded element nests within said sixth folded element;
an apex located on said sixth folded element;
said first folded element apex is fastened to said third folded element apex said second plane;
said second plane is parallel to said first plane;
said second folded element apex is fastened to said fourth folded element apex said third plane;
said third plane is parallel to said first plane;
said fifth folded element apex is fastened to said sixth folded element apex in a fourth plane;
said fourth plane is parallel to said first plane;
said first plane is located between said second plane and said third plane;
said fourth plane is located adjacent to said second plane;
a means for fastening said first and third folded elements in the second plane;
a means for fastening said second and fourth folded elements in the third plane;
a means for fastening said fifth and sixth folded elements in the fourth plane; and
a means for fastening said three-dimensional ornament to an identical three-dimensional ornament.

18. A method for making a three-dimensional ornament comprising at least one flexible, planar surface having a predetermined area and perimeter; said at least one flexible, planar surface having a centrally located spine; said spine having a left edge and a right edge and a center; said spine center located in a first plane; said spine dividing said at least one flexible, planar surface into a left and a right side; said spine left edge adjacent to said left side; said spine right edge adjacent to said right side; a first cut extending from said spine left edge into said left side and returning to said spine left edge; a first folded element and a second folded element formed from said first cut within said left side; the first folded element attached to said spine left edge; an apex located on said first folded element; the second folded element located attached to said spine left edge; an apex located on said second folded element; said first folded element nests within said second folded element; a second cut extending from said spine right edge into said right side and returning to said spine right edge; a third folded element and a fourth folded element formed from said second cut within said right side; the third folded element attached to said spine right edge; an apex located on said third folded element; the fourth folded element located attached to said spine right edge; an apex located on said fourth folded element; said third folded element nests within said fourth folded element; a third cut extending from said spine left edge into said left side and returning to said spine left edge; said third cut forming a fifth folded element within said left side; a fifth folded element attached to said spine left edge wherein said second folded element nests within said fifth folded element; an apex located on said fifth folded element; a fourth cut extending from said spine right edge into said right side and returning to said spine right edge; said fourth cut forming a sixth folded element within said right side; a sixth folded element attached to said spine right edge wherein said fourth folded element nests within said sixth folded element; an apex located on said sixth folded element; said first folded element apex is fastened to said third folded element apex said second plane; said second plane is parallel to said first plane; said second folded element apex is fastened to said fourth folded element apex said third plane; said third plane is parallel to said first plane; said fifth folded element apex is fastened to said sixth folded element apex in a fourth plane; said fourth plane is parallel to said first plane; said first plane is located between said second plane and said third plane; said fourth plane is located adjacent to said second plane; a means for fastening said first and third folded elements in the second plane; a means for fastening said second and fourth folded elements in the third plane; a means for fastening said fifth and sixth folded elements in the fourth plane; and a means for fastening said three-dimensional ornament to an identical three-dimensional ornament, said method comprising the steps of:

a. folding said first folded element towards said second plane;
b. folding said third folded element towards said second plane;
c. fastening said first folded element apex to said third folded element apex in said second plane;
d. folding said second folded element towards said third plane;
e. folding said fourth folded element towards said third plane;
f. fastening said second folded element apex to said fourth folded element apex in a third plane;
g. folding said fifth folded element towards said second plane;
h. folding said sixth folded element apex towards said second plane; and
i. fastening said fifth folded element apex to said sixth folded element apex in said second plane.

19. The method of claim 18 further comprising a step after step i of:

j. fastening a plurality of three-dimensional ornaments together.

20. The method of claim 19 further comprising a step after step j of:

k. hanging said three-dimensional ornament.

* * * * *